United States Patent [19]

Mueller

[11] 4,072,244

[45] Feb. 7, 1978

[54] LINERLESS CLOSURE

[75] Inventor: Bruce M. Mueller, Sylvania, Ohio

[73] Assignee: Owens-Illinois, Inc., Toledo, Ohio

[21] Appl. No.: 765,501

[22] Filed: Feb. 4, 1977

[51] Int. Cl.[2] ..... B65D 53/00

[52] U.S. Cl. ..... 215/344; 215/DIG. 1

[58] Field of Search ..... 215/DIG. 1, 344, 329

[56] References Cited

U.S. PATENT DOCUMENTS

| | | | |
|---|---|---|---|
| 3,055,526 | 9/1962 | Plunkett | 215/DIG. 1 |
| 3,203,571 | 8/1965 | Plunkett | 215/DIG. 1 |
| 3,255,907 | 6/1966 | Eddy | 215/DIG. 1 |
| 3,255,909 | 6/1966 | Miller | 215/DIG. 1 |

FOREIGN PATENT DOCUMENTS

| | | | |
|---|---|---|---|
| 1,229,322 | 4/1971 | United Kingdom | 215/DIG. 1 |

*Primary Examiner*—Donald F. Norton
*Attorney, Agent, or Firm*—A. J. Steger; E. J. Holler

[57] ABSTRACT

A linerless closure for a container having a neck portion terminating at its end in an annular rim defining the periphery of an open mouth, the annular rim including a substantially flat portion lying in a plane normal to the longitudinal axis of the neck and a primary sealing portion tapering downwardly from the flat portion. The closure includes a top panel with a cylindrical skirt depending from the periphery thereof and adapted to engage the neck of the container. A downwardly and outwardly depending annular sealing fin is provided on the inside of the top panel of the closure and is adapted to sealingly engage the primary sealing portion on the annular rim of the neck portion of the container. The linerless closure further includes an annular inclined stop portion formed integral therewith at the interior junction of the top panel and the depending skirt and which is adapted to stop the upward and outward deflection of the annular sealing fin upon application of the closure to the container to bias the sealing fin into sealing engagement with the primary sealing portion on the annular rim of the neck portion of the container.

1 Claim, 2 Drawing Figures

LINERLESS CLOSURE

BACKGROUND OF THE INVENTION

This invention relates to sealing closures for use on containers, such as containers which have neck portions having threads or other configurations adapted to cooperate with similar configurations on the closures. This invention is more particularly directed to linerless closures, those that do not require a separate lining means or gasket to effect a seal on the container.

In the past, linerless closures of a variety of different types have been provided for sealing the open mouth at the upper end of the neck portion of containers. Such closures are generally molded from a plastic material and have a top panel from which a cylindrical skirt extends, the skirt having internal threads adapted to engage similar threads on the external surface of the neck of the container. A variety of different configurations of sealing fins and resilient beads have been suggested to provide a tight seal with the end of the neck of the container when the closure is tightened thereon. In addition, some of the linerless closure configurations require the provision of a special finish on the upper annular rim of the container neck.

One such linerless closure is taught by U.S. Pat. No. 3,255,909 (Ira H. Miller et al), wherein a sealing fin of a specific configuration is adapted to engage an inclined sealing portion on the upper annular rim of the container neck. This particular combination requires the modification of the container neck molds, in order to produce the required taper on the neck finish. In addition, sealing fins of the type disclosed in this patent have been known to experience cold flow or creep after application to the container. This phenomenon sometimes reduces the resiliency of the sealing fin and diminishes the desired tight seal between the sealing fin and the container neck finish.

Another such linerless closure is that disclosed in U.S. Pat. No. 3,814,274 (James A. McIntosh). This patent teaches a linerless closure which may be utilized on a standard container neck finish. It features a prebent annular sleeve and an annular bead which deflets outwardly to engage the top of the annular sleeve to hold it in engagement with the container neck finish. However, because the annular bead is designed to deflect outwardly, only a portion of its flat lower surface engages the annular sleeve when the closure is applied to the container. In addition, the configuration of this flat bottom bead portion is not designed to compensate for cold flow or creep of the sealing fin after application of the closure to the container.

SUMMARY OF THE INVENTION

It is, therefore, an object of this invention to provide an improved linerless closure which overcomes the deficiencies of the linerless closures taught by the prior art. The linerless closure of this invention is adapted to sealingly close the open mouth of a container and maintain such a seal, even after repeated applications of the closure.

The linerless closure of this invention provides a downwardly and outwardly depending annular sealing fin on the inside of the top panel of the closure, which is adapted to engage a primary sealing portion on the upper annular rim on the neck finish of the container. The linerless closure further includes an annular inclined stop portion formed at the interior junction of the top panel and the depending skirt and which is adapted to stop the upward and outward deflection of the annular sealing fin upon application of the closure to a container to bias the sealing fin into sealing engagement with the primary sealing portion on the annular rim of the neck portion of the container. It is suggested that the angles of inclination of both the stop portion and the primary sealing portion on the container be selected to accommodate the included angle of the sealing fin and to bias the sealing fin therebetween.

It has been found that the use of the unique inclined stop member of this invention provides several advantages. This stop member is adapted to counteract cold flow or creep of the sealing fin after application of the closure by virtue of its inclined lower surface which provides a constant biasing action on the sealing fin against the primary portion of the upper annular rim of the container neck. It has also been found that "torque open" type cappers will work more effectively on the revised closure, since mating surfaces fit much more quickly and positively. Because of less time spent in the capper, it is possible to reduce application torque set points which will decrease the amount of stress applied to both the closure skirt and the top panel. In addition, the top load-bearing capacities of this closure will be improved over prior closures, since all flexible components are fully backed up by a solid member. Furthermore, the problem of top doming should be reduced or virtually eliminated, since the upward forces generated on the closure top panel will be shifted outwardly and will possess considerably less mechanical advantage, which is needed to elevate the top panel. Finally, the level of surface-active lubricant can be reduced or eliminated on the closure, which will result in improved removal torque retention.

Other objects, features and advantages of the subject invention will become obvious upon reference to the following detailed description and the drawings illustrating a preferred embodiment thereof.

IN THE DRAWINGS

DETAILED DESCRIPTION OF A SPECIFIC EMBODIMENT OF THIS INVENTION

Figure 1:
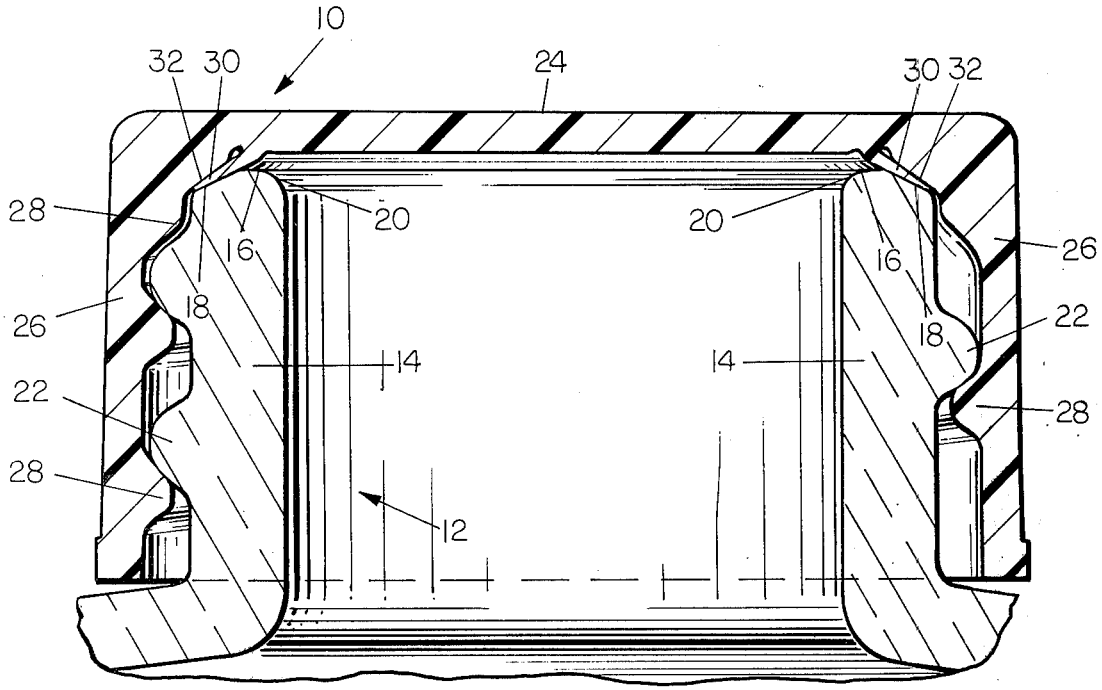
FIG. 1 is a partial, sectional view of the improved linerless closure of this invention fully applied into sealing engagement with the neck portion of a container.
Figure 2:
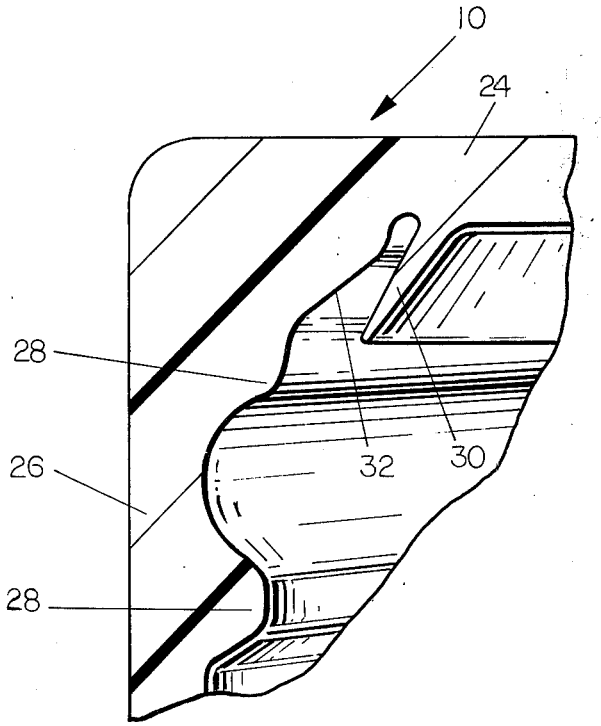
FIG. 2 is a partial, sectional view of the improved linerless closure of this invention prior to its application to a container.

The improved linerless closure of this invention is illustrated in FIGS. 1 and 2 and referred to generally by the numeral 10. The closure 10 is adapted to be applied to a container, indicated generally by the numeral 12, and it includes a neck portion 14 which terminates to its upper end in a substantially flat portion 16 and an inclined primary sealing portion 18, which is located outwardly from the flat portion 16. The flat rim portion 16 defines the periphery of an open mouth 20 of the container 12. The container neck portion 14 includes suitable engagement means, such as threads 22 on its outer surface which are adapted to matingly engage with corresponding parts on the closure 10.

The closure 10 includes a top panel 24 and an annular skirt portion 26 which depends downwardly from the outer periphery of the top panel 24. The annular skirt 26 incorporates suitable engagement means, such as threads 28, which are adapted to mate with the threads 22 on the container neck 14.

The closure 10 of this invention may be applied into sealing engagement with the container neck portion 14 without the use of a separate liner means or gasket through the use of a unique combination of elements which are an integral part of this closure. An annular, flexible sealing fin 30 depends downwardly and outwardly from the inside surface of the top panel 24. This annular sealing fin 30 is adapted to engage the inclined primary sealing portion 18 on the container neck 14, so that the open mouth 20 on the container 12 may be closed and sealed by the closure 10. The linerless closure 10 includes an annular, inclined stop portion 32 formed integral therewith at the interior junction of the top panel 24 and the depending skirt 26. As can be seen in FIG. 1, the inclined stop portion 32 is adapted to stop the upward and outward deflection of the annular sealing fin 30 upon application of the closure 10 to the container 12 to bias the sealing fin into engagement with the inclined primary sealing portion 18 on the container neck 14. It is suggested that the angles of inclination of the inclined stop member 32 and the inclined primary sealing portion 18 be selected to accommodate the included angle of the sealing fin and to bias the sealing fin therebetween. The included angle between the inner and outer surfaces of the sealing fin is approximately 12°. It is, therefore, recommended that the angle of inclination of the sealing surface 18 with the longitudinal axis of the closure be in the range of 60° to 70° and the angle of inclination of the inclined stop 32 with the longitudinal axis be between 48° and 58°.

Thus, the addition of the unique inclined stop member 32 results in the unique linerless closure of this invention which eliminates the deficiencies of the prior art and accomplishes all of the advantages hereinbefore discussed.

What I claim is:

1. In combination: a container having an externally threaded neck portion terminating at its end in an annular rim defining the periphery of an open mouth, said rim including a sealing surface tapering downwardly and outwardly from said open mouth; and a linerless closure comprising a top panel, an internally threaded skirt depending from said top panel and adapted to engage the threaded neck portion of said container, an annular resilient sealing fin depending downwardly and outwardly from the inside surface of said top panel, said annular sealing fin adapted to sealingly engage said sealing surface on the annular rim of the neck portion of the container, said linerless closure including an annular stop portion formed integral therewith at the interior junction of the top panel and the depending skirt, said stop portion being inclined downwardly and outwardly from said top panel to stop the upward and outward deflection of said annular sealing fin upon application of said closure to said container to thereby cooperate with the sealing surface on the annular rim of the neck portion of the container to firmly bias said sealing fin therebetween to form a seal between said linerless closure and said container.

* * * * *